United States Patent [19]

Braxton, Jr.

[11] Patent Number: 4,509,952

[45] Date of Patent: Apr. 9, 1985

[54] CHEMICAL COMPOSITION

[75] Inventor: Henry G. Braxton, Jr., Franklin, Mich.

[73] Assignee: Ethyl Corporation, Richmond, Va.

[21] Appl. No.: 250,093

[22] Filed: Apr. 1, 1981

[51] Int. Cl.[3] ..... C10L 1/22

[52] U.S. Cl. ..... 44/57; 44/72; 252/401

[58] Field of Search ..... 44/72, 57; 252/401

[56] References Cited

U.S. PATENT DOCUMENTS 2,758,086 8/1956 Stuart et al. ..... 44/72 X 3,707,362 12/1972 Zimmerman et al. ..... 44/72

*Primary Examiner*—Y. Harris-Smith

*Attorney, Agent, or Firm*—Donald L. Johnson; John F. Sieberth; W. G. Montgomery

[57] ABSTRACT

A minor amount of alkyldimethylamine may be added to a distillate fuel oil to stabilize the fuel oil against deterioration.

3 Claims, No Drawings

CHEMICAL COMPOSITION

BACKGROUND OF THE INVENTION

This invention relates to stabilized distillate fuels.

More particularly, the invention is concerned with fuel oils, such as diesel engine fuels and heating fuels that are normally susceptible to deterioration during transportation and storage. This deterioration usually results in the formation of insoluble sludge and sediment, color deterioration and disagreeable odor, especially at elevated temperatures. Fuel oil degradation is caused by polymerization and breakdown of hydrocarbons.

Historically, distillate fuel stabilizers have been amines. U.S. Pat. No. 3,490,882 indicates the use of N,N-dimethylcyclohexylamine as a stabilizer in distillate fuels. U.S. Pat. No. 3,304,162 claims a composition of a petroleum distillate fuel oil and a minor amount of a mixture of linoleic acid dimer and N-(3-dimethylaminopropyl) oleamide sufficient to stabilize the fuel oil against degradation.

With the increasing use of lower quality crudes, the need for additives to stabilize the fuel is expected to increase considerably over the next few years.

SUMMARY OF THE INVENTION

In accordance with the present invention, an alkyldimethylamine ranging from $C_4$–$C_{20}$ alkyl may be added to a distillate fuel as a stabilizer to prevent fuel oil degradation.

DESCRIPTION OF THE PREFERRED EMBODIMENT

The present invention pertains to petroleum distillate fuels containing a chemical additive which has shown an unexpected and unusual ability to prevent color deterioration, sludge formation, filter plugging, emulsification and rusting of storage containers.

More specifically, this invention provides a fuel oil composition comprising a petroleum distillate fuel oil and a minor amount of alkyldimethylamine, having the structure:

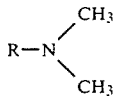

wherein R is a $C_4$–$C_{20}$ alkyl or mixture thereof, sufficient to stabilize said fuel oil against deterioration. This alkyldimethylamine may be present in the mixture in a range from about 0.001 weight percent to about 0.2 weight percent.

In a further embodiment of this invention R is a $C_8$–$C_{14}$ alkyl or mixture thereof. In a more preferred embodiment of this invention R is a $C_8$ alkyl.

The stabilizer of this invention is useful in petroleum distillate fuels which are essentially mixtures of hydrocarbons boiling in the range of 200°–900° F. This invention is particularly concerned with stabilizing such products as fuel oil for marine, automotive and locomotive diesel-type fuels, as well as military diesel fuels, off-highway diesel fuels, on-highway diesel fuels, jet engine fuels, turbine engine fuels, and electric utility diesel fuels for stand-by use.

In addition, the stabilizers are used in residential and commercial building heating oils such as furnace oil.

Other types of heating oil include refinery heating oils and electric utility heating oils.

The preferred petroleum distillate fuel oils for use in this invention are heating oils and diesel oils.

The R groups may range from $C_4$–$C_{20}$ alkyl and mixtures thereof. Preferably, R is a $C_8$–$C_{14}$ alkyl or mixture thereof, and more preferably, R is a $C_8$ alkyl.

Alkyldimethylamines are well known in the art. Alkyldimethylamines are available commercially from Ethyl Corporation and have a wide variety of known uses. Examples of such amines are dimethyl butylamine, dimethyl pentylamine, dimethyl hexylamine, dimethyl heptylamine, dimethyl octylamine, dimethyl nonylamine, dimethyl decylamine, dimethyl undecylamine, dimethyl dodecylamine, dimethyl tridecylamine, dimethyl tetradecylamine, dimethyl pentadecylamine, dimethyl hexadecylamine, dimethyl heptadecylamine, dimethyl octadecylamine, dimethyl nonadecylamine, and dimethyl eicosylamine.

Alkyldimethylamines have now been found to be economically attractive stabilizers for use in distillate fuels. Fuel oil deterioration is delayed, color degradation is inhibited and sludge formation is reduced. Alkyldimethylamines inhibit the reactions responsible for sludge formation.

Alkyldimethylamines are also ashless and nonextractable. Despite their dispersant action they are unlike many additives which create emulsions when the fuel containing them mixes with water.

The preferred alkyldimethylamine varies with the type and blend of petroleum distillate fuel selected. The following table lists seven distillate fuel samples and compares the deterioration of the fuel without a stabilizer with the deterioration found after treatment with dimethyl dodecylamine. In each fuel sample selected dimethyl dodecylamine inhibited the formation of insoluble sediment and color deterioration.

The test used to compare the effectiveness of dimethyl dodecylamine was the ASTM 149° C., 90 minute accelerated storage test. A measured volume of each distillate fuel was aged for 90 minutes at 149° C. in an open tube with air exposure. After aging and cooling the fuel was filtered and the amount of insoluble residue formed was estimated by determining the amount of light reflectance of the filter pad. The light reflectance ranged from zero to 20. The higher the filter pad rating the greater the amount of insoluble residue formed.

The results of the ASTM 149° C., 90 minute accelerated storage test could also be evaluated by color comparison of the treated and untreated distillate fuel samples. A low value of zero indicated white and the maximum rating of eight represented black.

In each fuel sample selected both the filter pad rating and color indicated greater distillate fuel stability with the proposed addition of dimethyl dodecylamine.

| | Treatment Conc. | Filter Pad Rating | | Color | |
|---|---|---|---|---|---|
| Fuel | (PTB) | Untreated | Treated | Untreated | Treated |
| 1 | 20 | 18 | 9–10 | 4.5 | 4.5 |
| 2 | 30 | 17 | 7 | 5.5 | 3.0 |
| 3 | 37 | 18 | 7 | 8.0 | 5.0 |
| 4 | 5 | 7 | 4 | 1.5 | 1.0 |
| 5 | 17 | 12 | 7 | 7.5 | 6.0 |
| 6 | 30 | 16 | 11–12 | 7.5 | 7.0 |

-continued

| Fuel | Treatment Conc. (PTB) | Filter Pad Rating | | Color | |
|---|---|---|---|---|---|
| | | Untreated | Treated | Untreated | Treated |
| 7 | 5 | 12 | 7-8 | 5.5 | 3.5 |

I claim:

1. A fuel oil composition consisting essentially of a petroleum distillate fuel oil selected from the group consisting of furnace oil and diesel fuel and a minor amount of alkyldimethylamine, having the structure:

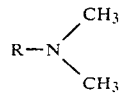

wherein R is a straight chain $C_4$–$C_{20}$ alkyl or a mixture thereof, sufficient to stabilize said fuel oil against deterioration.

2. A fuel oil composition of claim 1 wherein R is a straight chain $C_8$–$C_{14}$ alkyl or mixture thereof.

3. A fuel oil composition of claim 2 wherein R is a straight chain $C_8$ alkyl.

* * * * *